US005832939A

United States Patent [19]

Nathe

[11] Patent Number: 5,832,939

[45] Date of Patent: Nov. 10, 1998

[54] HAIR WAVING APPLIANCE

[76] Inventor: Marcus Nathe, 2945 A S. Fairview St., Santa Ana, Calif. 92704

[21] Appl. No.: 746,771

[22] Filed: Nov. 15, 1996

[51] Int. Cl.[6] ..... A45D 2/40; A45D 2/42

[52] U.S. Cl. ..... 132/225; 132/224; 132/229; 132/118; 219/225

[58] Field of Search ..... 132/225, 224, 132/229, 231, 232, 234, 117, 118; 219/225, 255, 525, 282, 538, 539, 222

[56] References Cited

U.S. PATENT DOCUMENTS

| | | | |
|---|---|---|---|
| 1,449,632 | 3/1923 | Talbot | 219/225 |
| 1,591,207 | 7/1926 | Berthelsen | 219/225 |
| 1,656,142 | 1/1928 | Cocroft | 132/225 |
| 1,694,672 | 12/1928 | Rogler | 132/225 |
| 4,151,850 | 5/1979 | Nathe et al. | 132/225 |
| 4,917,078 | 4/1990 | Zabrowski | 219/225 |
| 4,939,540 | 7/1990 | Brill | 219/225 |
| 5,119,846 | 6/1992 | Tadrous et al. | 132/225 |

*Primary Examiner*—Gene Mancene
*Assistant Examiner*—Pedro Philogene
*Attorney, Agent, or Firm*—Steins & Associates

[57] ABSTRACT

An improved hair waving appliance is disclosed. The disclosed hair waving, appliance includes a pair of W-shaped arms that pivot in relation to one another in a scissors motion. One disclosed W-shaped arm comprises a center raised heater prong bounded by a trough portion on each side. The outer edges of each trough portion may include a curved lip to prevent undue damage to hair. Another W-shaped arm is disclosed comprising two raised heated prongs separated by a trough portion. The disclosed arms fit together to form an interstitial gap therebetween such that more even temperatures are provided over the entire surface of each arm. The disclosed prongs might be of a variety of cross sections, including ovoid and substantially circular. Further disclosed is a plurality of stand members protruding downwardly from the appliance for resting the appliance upon a substantially horizontal surface without causing any heat damage thereto. Still further disclosed are heat insulated tips on each said prong such that an operator might grasp said tips to provide additional leverage when pressing a lock of hair. Also disclosed are slight discolorations for indicating when the target temperature is reached and an integral temperature control. The handles of the disclosed appliance may be ergonomically contoured to provide greater comfort for the user.

17 Claims, 5 Drawing Sheets

HAIR WAVING APPLIANCE

BACKGROUND OF THE INVENTION

1. Field of the Invention

This invention relates generally to hair waving appliances and more particularly to heated hair wavers of the jaw type.

2. Description of Related Art

Heated hair curlers are well known in the art. The most common type as exemplified by U.S. Pat. No. 1,691,115 is a scissors-type device having an electrically heated prong which can be accommodated by a jaw having a U-shaped cross-section. Such curlers were popular during the 1920's and 1930's when women's hair styles were directed to tight uniform curls and waves. For filler curls, it was necessary to turn and twist the curler which could result in weakening or breaking the hair. Today, the trend is to a more natural look with softer waves. Softer waves can be obtained by using a two pronged hair curler with an electrically heated W-shaped trough such as shown in U.S. Pat. No. 1,488,621. Such a hair waver, while capable of producing waves, requires a certain amount of expertise and practice. In addition, the waves cannot get as close to the scalp as desired and the user runs the risk of burning or otherwise damaging the hair from overheat. Furthermore, only one side of the hair in the curler is heated, resulting in weak, short-lasting waves.

U.S. Pat. No. 4,151,850 solved many of these problems with the prior devices. What was disclosed was an electrically-heated hair waving appliance that comprised three heated prongs. The center, upper prong is centered within a W-shaped trough that accepted the other two prongs on either side of the upper prong. In such a fashion, hair could be placed within the W-shaped trough, after which the jaws would be closed, thereby pressing and heating the hair into the W-shape to create a wave.

Although the device of the '850 patent solved many of the problems with the prior devices, some areas were not addressed or resolved. First, the '850 device only included the lower W-shaped trough; this left the top of the jaws open, which allowed heat to escape and resulted in inconsistent wave strength. What is needed is a pair of cooperating troughs that form a heated chamber such that all of the hair in the appliance is heated evenly, consistently and efficiently.

A further problem with the '850 patent is that of insufficient leverage to close the jaws of the device on the hair being waved. The only crimping force exerted on the jaws was created by pressing the handles together. When particularly thick hair was being curled, or when the operator of the device began getting tired, the compressing force on the hair became weaker and inconsistent. Furthermore, the operator could experience discomfort in the hand and arm from prolonged use of the device. If the operator could use both hands to compress the jaws together, these problems would be minimized.

A still further problem with the '850 device is the shape of the trough and prongs. The device included prongs with a circular cross-section and a trough with sharp edges. The resultant path of the hair being waved was inconsistent from one row of waves to the next, since the center of the trough was oblong-shaped. This was compounded by the sharp edges of the trough, which allowed the hair to make a sharp bend at the entrance and exit of the appliance, which might be damaging to the hair. If the prongs and trough were oblong and the edges of the trough(s) included lips or contoured edges, the waves from one row to the next would match up well. Furthermore, the lips would match the contour of the wave rows such that the hair entering and exiting the appliance would not encounter a sharp edge that might damage the hair.

SUMMARY OF THE INVENTION

In light of the aforementioned problems associated with the prior devices, it is an object of the present invention to provide an Improved Hair Waving Appliance. Said hair waving appliance should include a pair of W-shaped arms further including heated prongs and heat-conductive troughs that pivot in relation to one another in a scissors motion. In order to prevent hair damage, the outer edges of each trough portion may include a curved lip. When closed, it is an object that the two arms fit together to form an interstitial gap between them where a constant temperature may be maintained. Each prong may be shaped in a variety of ways, including ovoid and substantially circular, among others. The present invention may also include several protrusions extending down from the appliance, configured for resting the appliance upon a substantially horizontal surface without causing any heat damage to it. As an added comfort and safety feature, it is another object that the prongs of the present invention include heat-insulated tips that are cool to the touch, such that an operator might grasp said tips to provide additional leverage when pressing a lock of hair. Said device may also include an indicating means for indicating when the target temperature is reached by the device and also an integral temperature control. It is also an object that the handles of the appliance may be ergonomically contoured to provide greater comfort for the user.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an Improved Hair Waving Appliance.

Figure 1:
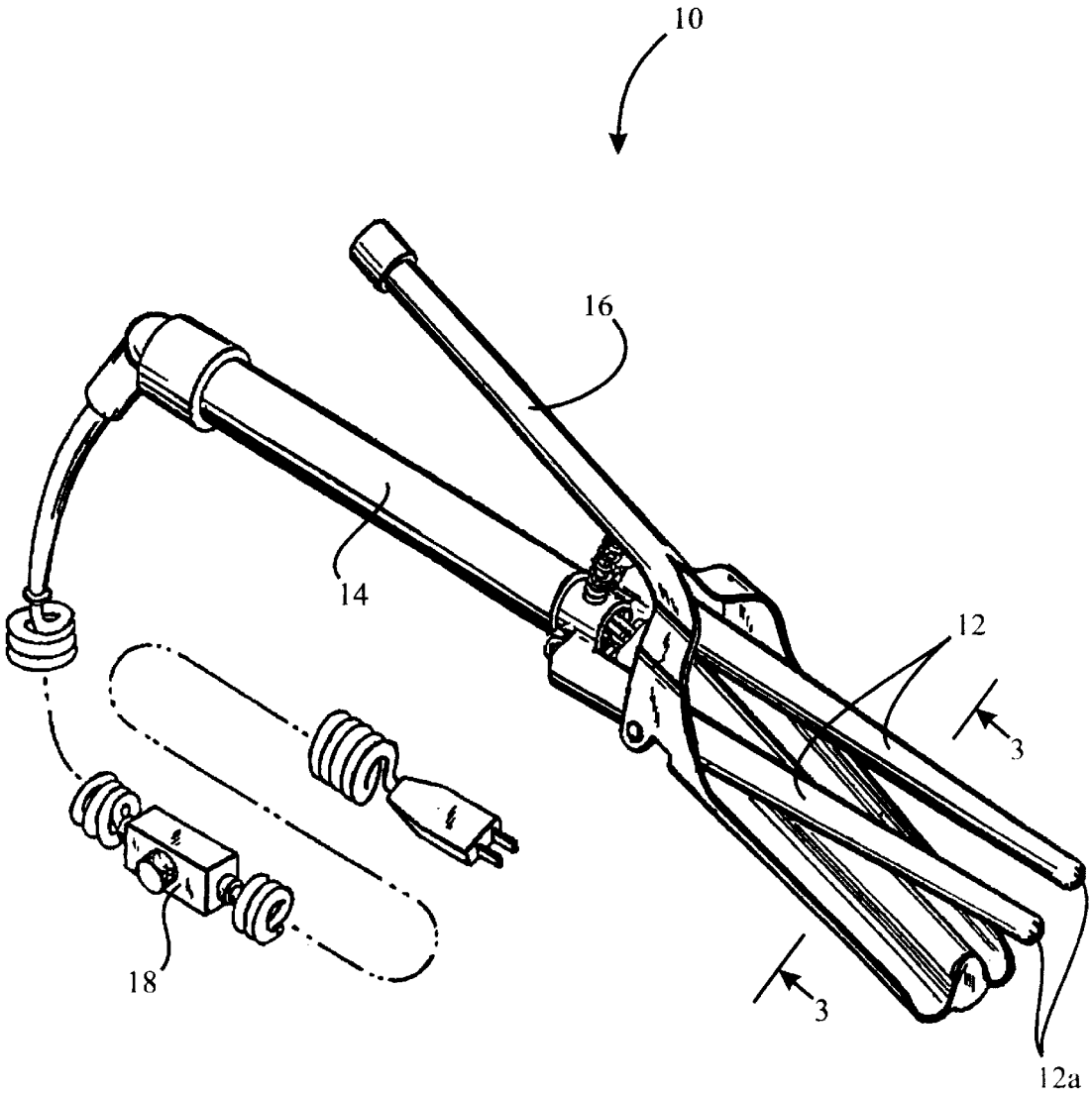
FIG. 1 is a perspective view of the prior appliance of U.S. Pat. No. 4,151,850.

The present invention can best be understood by initial consideration of FIG. 1. FIG. 1 is a perspective view of the prior hair waving appliance 10 of U.S. Pat. No. 4,151,850, showing the general arrangement of elements. In particular, one must note that the pair of prongs 12 are completely separate from one another, and that their ends 12*a* are contiguous with the metal body of the prongs 12. Furthermore, one must note the shape and arrangement of the first handle 14 and second handle 16. As can be seen the first and second handles 14 and 16 are essentially straight and do not conform to the user's hand nor to each other. Also depicted in FIG. 1 is the heat control element 18, which is separate from the body of the appliance 10.

Figure 2:
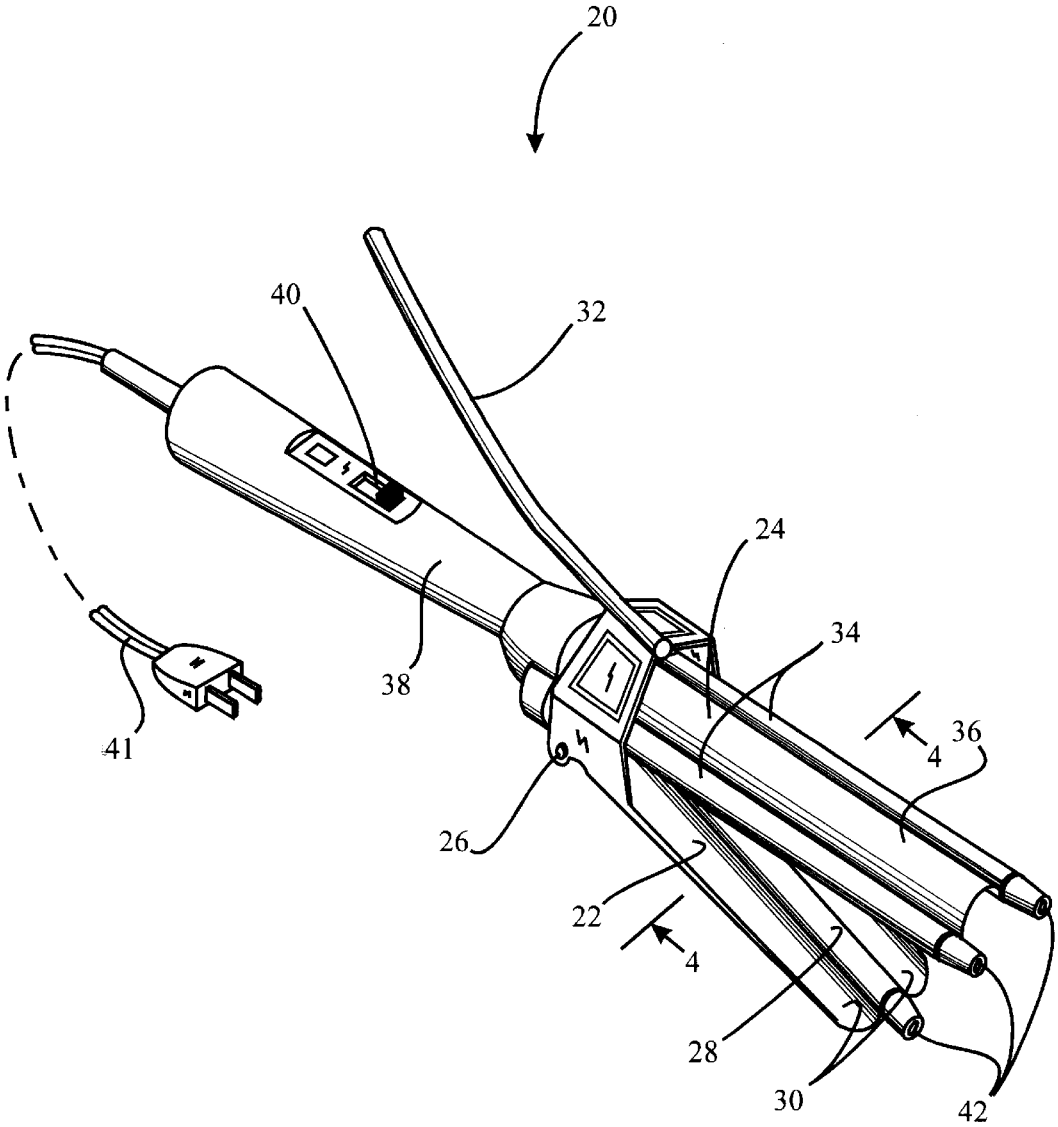
FIG. 2 is a perspective view of a preferred embodiment of the improved device of the present invention.

Turning now to FIG. 2, one might begin to appreciate some of the advancements of the present invention. FIG. 2 is a perspective view of a preferred embodiment of the improved hair waving appliance 20 of the present invention. The improved appliance 20 comprises a first arm 22 and a second arm 24, which are attached to one another by an attachment means 26, such as by screw, pin, or other element that permits pivotal scissors movement between the first arm 22 and the second arm 24.

The first arm 22 comprises a center prong 28, to which is attached a pair of trough members 30. The center prong 28 comprises a heating element with an outer shell of metal or other conductive material. The pair of troughs 30 are made of a heat-conductive material, such as metal, and are fixed to the center prong 28, such that they will conduct heat from the center prong 28 and across their width. The outer surface of the center prong 28 and the pair of trough members 30 may be coated with a variety of materials, such as non-stick, heat-resistant polymers or even chrome, depending upon the application for which the appliance 20 is intended.

Extending backwardly from the first arm 22 is a first handle 32. The first handle 32 may comprise a variety of shapes and configurations, depending upon the application. As can be seen, a preferred configuration for the first handle 32 is a contoured rod, or "Marcel Rod", which is common for professional handheld haircare appliances.

The second arm 24 comprises a pair of substantially parallel prongs 34. The prongs 34 are connected to one another by a center trough member 36, a feature unique to the present invention. As is depicted in the Figure, the center trough member 36 is configured to accept the center prong 28 into it when the first arm 22 is pressed towards the second arm 24. The outer surface of the parallel prongs 34 and the center trough member 36 may be coated with a variety of materials, such as non-stick, heat-resistant polymers or even chrome, depending upon the application for which the appliance 20 is intended.

The second arm 24 transitions into the second handle 38. The second handle 38 is preferably an ergonomically-contoured handle made from a durable, heat-resistant material, such as a type of plastic. A unique feature to the improved hair waving device 20 is the heat control means 40 which is integral to the second handle 38. The heat control means 40 controls the amount of current passing through the heating elements located in the prongs 28 and 34, so that the desired temperature may be maintained. As depicted, the heat control means 40 may be a three-position switch, comprising positions for "off", "on" and "standby". Standby may be a low-temperature setting that reduces the time required to warm up the appliance prior to use, while still conserving energy while the unit is not being used. The heat control means 40 may be part of an electrical circuit with the wire 41, that ultimately may be plugged into a standard household outlet.

A further unique aspect of the present invention are the tips 42 that may comprise the outer ends of the center prong 28 as well as the pair of prongs 34. These tips 42 are made from a non-heat-conductive material, such as heat-resistant plastic. When the prongs 28 and 34 and troughs 30 and 36 are hot, therefore, the tips 42 will remain cool to the touch. In such a manner, the user will be afforded improved leverage in pressing the first arm 22 towards the second arm 24. This improved leverage permits the user to exert more force onto hair trusses being waved, and also reduces the force required by the single hand pressing the first handle 32 towards the second handle 38.

Figure 3:
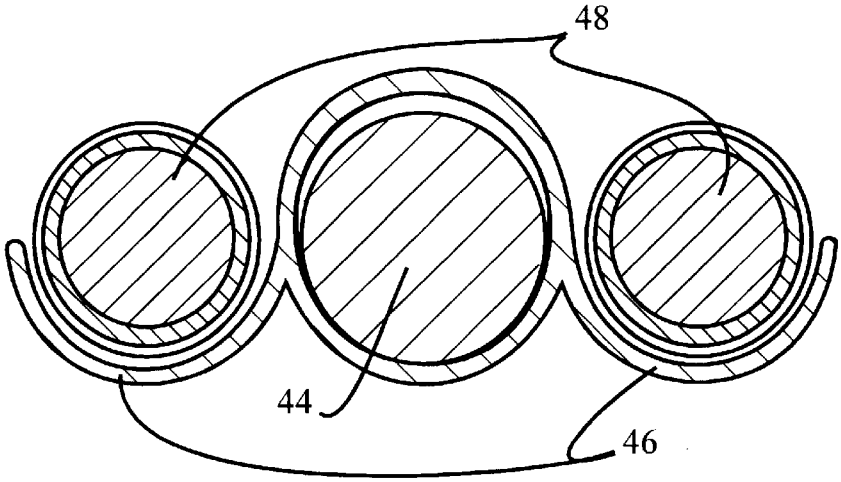
FIG. 3 is a cross section along the line 3—3 of the prior appliance of FIG. 1 when closed.

FIG. 3 prepares us to further understand the unique shape and functioning of the present invention. FIG. 3 is a cross section along the line 3—3 of the prior appliance 10 of FIG. 1 when the unit is closed. As can be seen, the prior unit comprised a center prong 44, bounded by a pair of trough members 46 into which fit a substantially circular pair of prongs 48. As can be seen, there was no center trough member 36 (see FIG. 2) as with the present invention.

Figure 4:
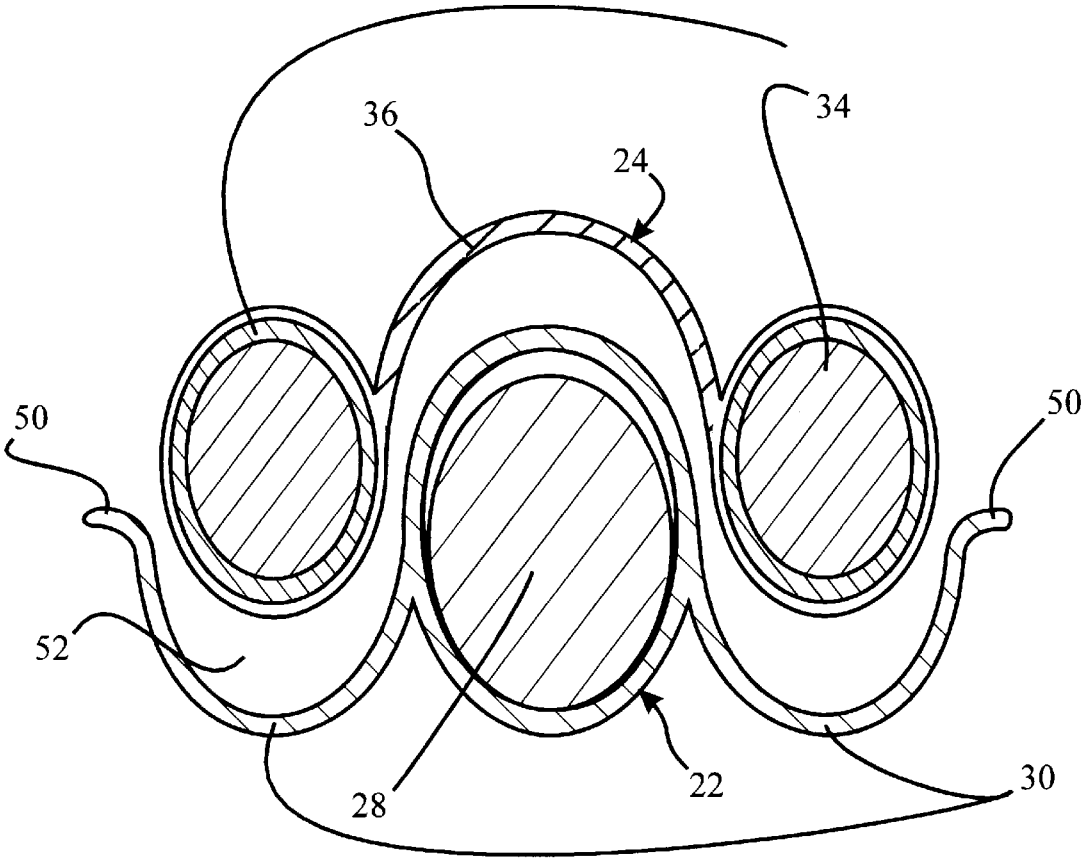
FIG. 4 is a cross section along the line 4—4 of the improved device of FIG. 2 when closed.

Contrast, now, FIG. 4 with FIG. 3. FIG. 4 is a cross section along the line 4—4 of the improved device 20 of FIG. 2 when the device is substantially closed. As can be seen, there is a center prong 28 bounded by a pair of trough members 30, into which the pair of prongs 34 and center trough member 36 are contoured to fit. When closed or substantially closed, therefore, an interstitial gap 52 is formed between the first arm and the second arm. The heat radiating from the components of the first arm 22 and the second arm 24 will be substantially captured within the interstitial gap 52, such that a uniform temperature will be maintained across the entire surfaces of the first arm 22 and second arm 24. This interstitial gap 52 also permits the hair trusses to undulate back and forth as they pass across the first arm 22 and the second arm 24, such that more complex and beautiful waves are created in the hair.

As further shown in FIG. 4, the center prong 28 and pair of prongs 34 have an oval cross section. The oval cross section will result in deeper waves in the hair treated by the present invention. Other embodiments may include other shapes, depending upon the desired application for the device, including the substantially circular cross section of the prior device of FIG. 3.

A further unique feature of the improved hair waving appliance of the present invention are the lips 50 along the outer edges of the pair of trough members 30. These lips present more gentle curves to hair trusses entering and exiting the device. The gentleness of the curve may prevent damage, such a breakage, to the hair, and will also provide a path that is more consistent with that traveled between the center prong 28 and the pair of prongs 34.

Figure 5:
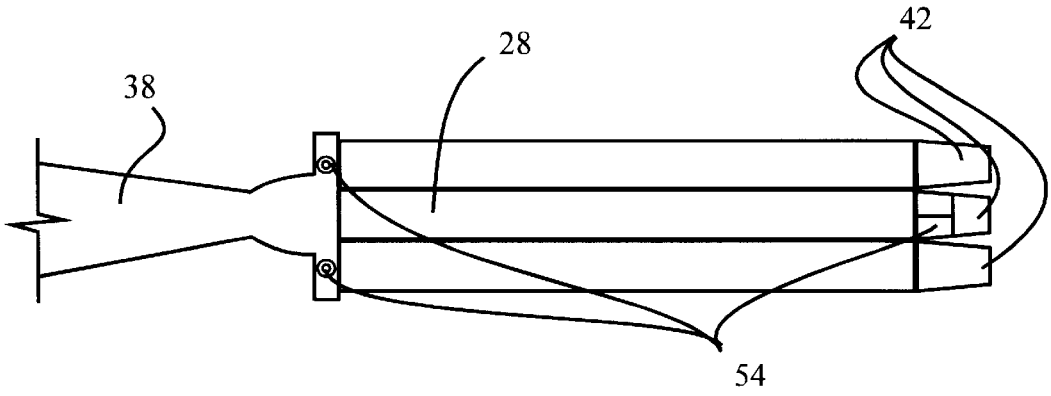
FIG. 5 is a bottom view of the improved device of FIGS. 2 and 4 showing detail of the vanity rests.
Figure 6:
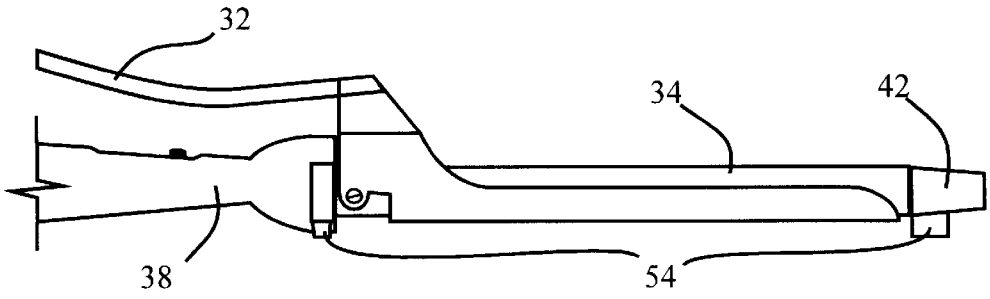
FIG. 6 is a side view of the improved device of FIGS. 2, 4 and 5 showing detail of the vanity rests.

FIGS. 5 and 6 give further detail into another unique feature of the present invention. FIG. 5 is a bottom view of the improved device of FIGS. 2 and 4. As can be seen in FIG. 5, there are a plurality of stand members 54 protruding from the device. The embodiment depicted includes a pair of stand members 54 protruding downwardly from the second handle 38 and a single stand member 54 protruding downwardly from the tip 42 of the center prong 28. Numerous other configurations are possible, including fewer or more stand members 54 than shown here, and also alternative locations for the stand members 54. These stand members 54 are configured to support the device at a distance above any horizontal surface upon which it is placed, in order to prevent bums and/or ignition of flammable materials.

FIG. 6 gives additional detail about the stand members 54. FIG. 6 is a side view of the improved device of FIGS. 2, 4 and 5. As can be seen, the stand members 54 extend downwardly below the second handle 38, the prongs 34 and any other elements of the device.

Figure 7:
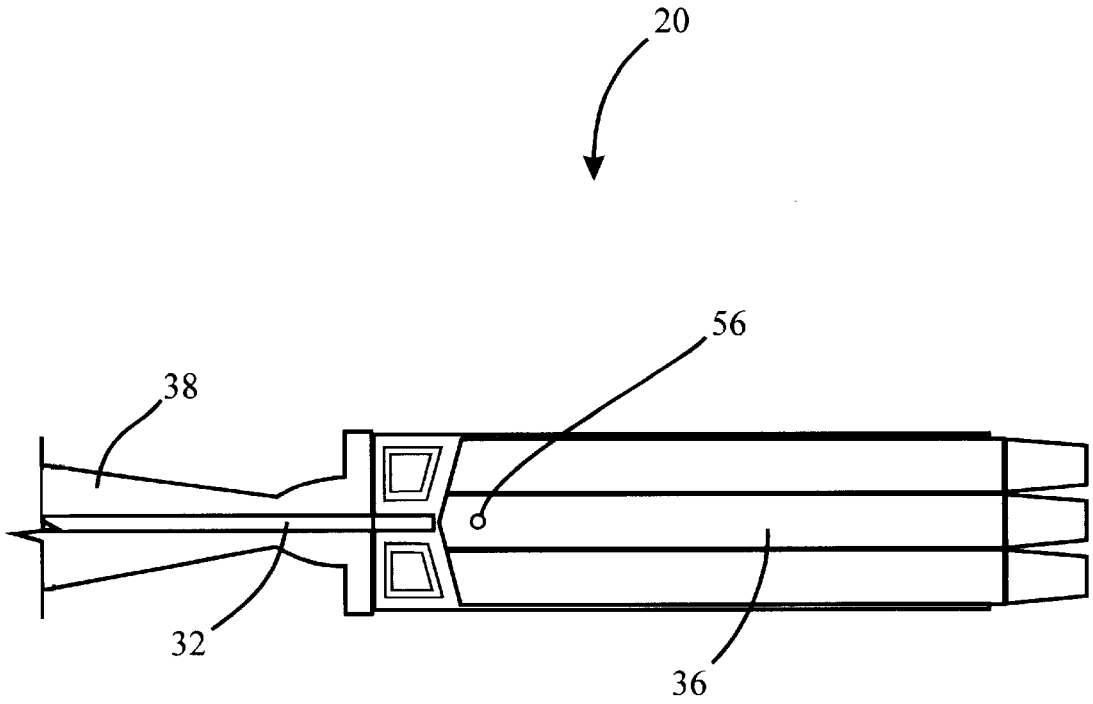
FIG. 7 is a partial top view of the improved device of FIGS. 2, 4, 5 and 6 showing the ready indicator.

Now turning to FIG. 7, another unique feature of the present invention 20 might be appreciated. FIG. 7 is a partial top view of the improved device of FIGS. 2, 4, 5 and 6 showing the indicating means 56 for indicating when the device 20 is at the desired temperature. The indicating means 56 might operate in many different ways such that a color change or other indication perceptible to the human senses occurs when the target temperature is reached. In the depicted embodiment, the indicating means 56 is actually a depression formed in the center trough member 36 such that when the jaws of the device 20 are closed, the inner surface of the center trough member 36, in the region of the indicating means 56, comes in contact with the center prong (see FIG. 2). As a result of being in direct contact with the heated center prong (see FIG. 2), the indicating means 56 will rise to a higher temperature than the rest of the center trough member 36, thereby creating a slight discoloration that is visually perceptible to the operator of the device 20.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An improved hair waving appliance comprising:

a first arm comprising a first prong of heat conducting material and further comprising an electrical heating element, said first arm further comprising a pair of semi-circular trough members of heat conducting material, each said trough member fixed to opposite sides of said first prong and extending axially along said first prong length;

a first handle connected to one end of said first prong and said trough members;

a second arm comprising a pair of spaced parallel prongs of heat conducting material and each said prong further comprising an electrical heating element, said second arm further comprising a third semi-circular trough member of heat conducting material fixed between said pair of prongs and extending axially along their length, said pair of prongs and said third trough member configured to accept said first prong and said pair of trough members in substantially aligned relation whereby a lock of hair can extend in undulating fashion between said first prong and pair of trough members of said first arm and said parallel prongs and third trough member of said second arm and said lock of hair receives heat from said prongs and said trough members;

a second handle connected to one end of said pair of prongs and said third trough member;

a connecting means for pivotably connecting said first arm to said second arm whereby squeezing the handles together will force said first prong into said third trough member and said pair of prongs into said pair of trough members; and an electrical cable passing through one of said handles, said cable having a first end connected to each of said heating elements and a second end adapted to be connected to a source of electricity.

2. The improved hair waving appliance of claim 1, further comprising an interstitial gap formed between said first prong and said pair of trough members of said first arm and said pair of prongs and said third trough member of said second arm, whereby heat is captured therein to provide more efficient heating of said lock of hair.

3. The improved hair waving appliance of claim 2, where in s aid pair of trough members further comprise:

inner edges where each said trough is fixed to said opposite sides of said first prong; and outer edges, opposite to said inner edges and further defining substantially curved lips for protecting said lock of hair from breakage.

4. The improved hair waving appliance of claim 3, wherein said first prong is further defined by a first substantially heat insulating tip fixed to the end of said first prong opposite from said first handle; and each prong of said pair of prongs is further defined by a substantially heat insulating tip fixed to the ends of said pair of prongs opposite from said second handle.

5. The improved hair waving appliance of claim 4, further comprising a plurality of stand members protruding from said second handle and said first tip, for resting said hair waving appliance on a substantially horizontal surface.

6. The improved hair waving appliance of claim 5, further comprising an indicating means, perceptible to the human senses, for indicating when said first arm and said second arm are at the desired temperature.

7. The improved hair waving appliance of claim 6, wherein said second handle has an ergonomically-contoured shape.

8. The improved hair waving appliance of claim 7, further comprising an integral heat control means connected to said cable.

9. The improved hair waving appliance of claim 8, wherein said first prong, said pair of trough members, said pair of prongs and said third trough member comprise a substantially ovoid cross-section for providing deeper waves to said lock of hair.

10. The improved hair waving appliance of claim 9, wherein said first handle comprises a rod substantially contoured to said second handle.

11. An improved hair waving appliance comprising:

a first arm comprising a first prong of heat conducting material and further comprising an electrical heating element, said first arm further comprising a pair of semi-circular trough members of heat conducting material, each said trough member fixed to opposite sides of said first prong and extending axially along said first prong length;

a first handle connected to one end of said first prong and said trough members;

a second arm comprising a pair of spaced parallel prongs of heat conducting material and each said prong further comprising an electrical heating element, said second arm further comprising a third semi-circular trough member of heat conducting material fixed between said pair of prongs and extending axially along their length;

an interstitial gap formed between said pair of prongs and said third trough member and said first prong and said pair of trough, whereby a lock of hair can extend in undulating fashion through said interstitial gap and said lock of hair receives heat from said prongs and said trough members;

a second handle connected to one end of said pair of prongs and said third trough member;

a connecting means for pivotably connecting said first arm to said second arm whereby squeezing the handles together will force said first prong into said third trough member and said pair of prongs into said pair of trough members; and an electrical cable passing through one of said handles, said cable having a first end connected to each of said heating elements and a second end adapted to be connected to a source of electricity.

12. The improved hair waving appliance of claim 11, wherein said pair of trough members further comprise:

inner edges where each said trough is fixed to said opposite sides of said first prong; and outer edges, opposite to said inner edges and further defining substantially curved lips for protecting said lock of hair from breakage.

13. The improved hair waving appliance of claim 12, wherein:

said first prong is further defined by a first substantially heat insulating tip fixed to the end of said first prong opposite from said first handle, said tip further defined by a stand member protruding downwardly therefrom;

each prong of said pair of prongs is further defined by a substantially heat insulating tip fixed to the ends of said pair of prongs opposite from said second handle; and said second handle further comprises at least one stand member protruding downwardly therefrom, said stand members configured for resting said hair waving appliance on a substantially horizontal surface.

14. The improved hair waving appliance of claim 13, wherein said third trough member further comprises an indicating means, perceptible to the human senses, for indicating when said first arm and said second arm are at the desired temperature.

15. The improved hair waving appliance of claim 14, wherein said second handle further comprises an ergonomically-contoured shape and an integral heat control means connected to said cable.

16. The improved hair waving appliance of claim 15, wherein said first prong, said pair of trough members, said pair of prongs and said third trough member comprise a substantially ovoid cross-section for providing deeper waves to said lock of hair.

17. The improved hair waving appliance of claim 16, wherein said first handle comprises a rod substantially contoured to said second handle.

* * * * *